US006789293B2

(12) United States Patent
Habegger et al.

(10) Patent No.: US 6,789,293 B2
(45) Date of Patent: Sep. 14, 2004

(54) DAMPENED HINGE SYSTEM FOR APPLIANCE DOOR

(75) Inventors: Jeffrey D. Habegger, Wadsworth, OH (US); Steven O. Cummins, Mansfield, OH (US)

(73) Assignee: Mansfield Assemblies Co., Mansfield, OH (US)

( * ) Notice: Subject to any disclaimer, the term of this patent is extended or adjusted under 35 U.S.C. 154(b) by 0 days.

(21) Appl. No.: 09/965,302

(22) Filed: Sep. 27, 2001

(65) Prior Publication Data

US 2003/0056328 A1 Mar. 27, 2003

(51) Int. Cl.[7] ..... E05D 11/10

(52) U.S. Cl. ..... 16/343; 16/374; 16/297; 16/289; 16/321

(58) Field of Search ..... 16/343, 374, 297, 16/289, 344, 306, 331, 332, 321, 362; 49/386, 389; 126/194, 192, 190

(56) References Cited

U.S. PATENT DOCUMENTS

| | | | | | |
|---|---|---|---|---|---|
| 2,124,349 | A | | 7/1938 | Herbster | |
| 3,712,287 | A | * | 1/1973 | Summers, Jr. | 126/191 |
| 3,749,080 | A | * | 7/1973 | Kleinhenn | 126/191 |
| 3,842,542 | A | * | 10/1974 | White et al. | 126/194 |
| 4,001,973 | A | * | 1/1977 | Rice et al. | 126/191 |
| 4,269,165 | A | * | 5/1981 | Wrotny et al. | 126/191 |
| 4,294,226 | A | * | 10/1981 | Feinberg | 126/286 |
| 5,025,776 | A | * | 6/1991 | Hanley et al. | 126/194 |
| 5,291,634 | A | * | 3/1994 | Zanetti | 16/333 |
| 5,822,925 | A | * | 10/1998 | McKinney et al. | 126/194 |
| 5,937,481 | A | * | 8/1999 | Faringosi | 126/191 |
| 6,041,548 | A | * | 3/2000 | Miller | 16/366 |
| 6,167,977 | B1 | * | 1/2001 | Adamson et al. | 16/289 |
| 6,397,836 | B1 | * | 6/2002 | Pelletier et al. | 126/194 |
| 6,453,510 | B1 | * | 9/2002 | Cummins et al. | 126/194 |

FOREIGN PATENT DOCUMENTS

| | | | |
|---|---|---|---|
| CH | 557507 | | * 12/1974 |
| DE | 29 39 727 | A1 | 4/1981 |
| DE | 4108816 | A1 | * 9/1992 |
| DE | 19824148 | A1 | * 5/1998 |
| EP | 0 269 134 | B1 | 6/1988 |
| EP | 0422565 | A2 | * 4/1991 |
| EP | 0565809 | A1 | * 10/1993 |
| EP | 0632180 | A1 | * 1/1995 |
| EP | 0810342 | A1 | * 12/1997 |
| EP | 0851084 | A1 | * 7/1998 |
| EP | 1039231 | A2 | * 1/2000 |
| EP | 1055882 | A2 | * 11/2000 |

* cited by examiner

*Primary Examiner*—Chuck Y. Mah
(74) *Attorney, Agent, or Firm*—Fay, Sharpe, Fagan, Minnich & McKee, LLP

(57) ABSTRACT

A dampened hinge and hinge system for appliances is provided. The system includes first and second hinge portions, at least one of which includes a dampener. The dampener can be a push-dampener, a pull-dampener or a push/pull-dampener. The hinge system allows for movement of the door between a closed position, a fully opened position and a secondary opened position such as a broil-stop position, and the door is self-supporting in the secondary opened position. The first and second hinge portions each include a guide channel, a claw pivotably connected to the guide channel and a link having a first end connected to the claw. The first hinge portion includes a spring having a first end connected to a second end of the link and a second end connected to the guide channel. The second hinge portion includes a dampener that is operably connected between the guide channel and the second end of the link. Both the first and second hinge portions can include a dampener.

25 Claims, 8 Drawing Sheets

DAMPENED HINGE SYSTEM FOR APPLIANCE DOOR

REFERENCE TO INVENTION DISCLOSURE DOCUMENT

At least portions of the development described in this patent application are also described in Disclosure Document No. 482129 filed in the U.S. Patent and Trademark Office on Nov. 6, 2000.

BACKGROUND OF THE INVENTION

The present invention relates to a hinge system for appliances and, more particularly, to a self-contained dampened hinge system and appliances incorporating same. The hinge system of the present invention is described herein with reference to its use as an oven or stove door hinge system (the terms "oven and "stove" are used interchangeably herein). Those of ordinary skill in the art will appreciate, however, that a hinge system formed in accordance with the present invention can be used as a door hinge system for a wide variety of other appliances such as clothes washers and dryers, dishwashers and the like.

Appliance manufacturers continue to seek improved performance characteristics with respect to the connection of doors to the appliance body and movement of the door relative to the body. With respect to oven doors, manufacturers and consumers have expressed a desire for doors that exhibit dampened-open and/or dampened-close characteristics. In a typical configuration, the oven door must be pulled open manually until it defines an angle of about 30° with the oven body, at which time the oven door will fall under its own weight in a slow, gentle and controlled manner until it is fully open and defines an angle of 90° with the oven body. With dampened-close, the oven door is moved manually from the fully open (about 90°) position to a partially closed position (e.g., where it defines an angle of about 60° with the oven body) after which it closes the remainder of the distance in a slow, gentle and controlled manner under force of a spring or other biasing means that is part of the hinge assembly.

Prior attempts to provide an oven door exhibiting these dampened-open/dampened-close characteristics have been deemed sub-optimal for a wide variety of reasons. In prior arrangements, with respect to door opening, attempts have been made to reduce door-opening resistance (such as reducing counter-weight or reducing door-closing biasing force). This allows the door to open under its own weight, but has the undesired effect of increasing the speed at which the door opens which can lead to noise, vibration, damage to the oven and disruption of delicate contents of the oven such as soufflés or cakes.

In other prior arrangements, dampeners and/or gas-springs have been employed in tandem with conventional hinge assemblies in an effort to achieve the desired dampened-open and dampened-close effects. These dampeners and/or gas-springs have not been incorporated into the hinge assemblies. This leads to increased complexity which increases costs of manufacture and repair. Furthermore, to provide both dampened-open and dampened-close characteristics, the complexity increases even further.

In addition to the foregoing, some prior oven doors and the like and movement dampeners have not provided or allowed for secondary door positions such as one or more partially opened positions for broiling or the like. Also, prior systems have not allowed for convenient swapping or changing of the dampening means, itself, i.e., use of either gas-filled or oil-filled dampeners, without significant redesign of the hinge, door and/or oven, itself.

Another deficiency of conventional systems is that they must be installed during assembly of the appliance and cannot be installed by the appliance re-seller as an add-on feature. Furthermore, prior arrangements have not allowed for adjustment of the speed at which the door opens/closes in a dampened fashion.

In light of the foregoing, it has been deemed desirable to provide a hinge system for oven doors and other appliance doors that overcomes the above-noted deficiencies and others while providing better overall results.

SUMMARY OF THE INVENTION

In accordance with a first aspect of the present invention, a dampened hinge system for connecting an appliance door to an appliance body includes first and second hinge portions each comprising a guide member adapted for connection to an associated appliance door, a claw pivotably connected to the guide member and adapted for engagement with an associated appliance body, and a link pivotably connected to the claw. A spring has a first end connected to the link of the first hinge portion and a second end connected to the guide member of the first hinge portion. A dampener is operably connected between the link of the second hinge portion and the guide member of the second hinge portion.

In accordance with another aspect of the present invention, an appliance comprises a body, a door and first and second hinge portions for pivotably connecting the door to the body. Each of the first and second hinge portions comprises a guide member adapted for connection to the door, a claw pivotably connected to the guide member and adapted for engagement with the body, and a link pivotably connected to the claw. A spring has a first end connected to the link of the first hinge portion and a second end connected to the guide member of the first hinge portion. A dampener is operably connected between the link of the second hinge portion and the guide member of the second hinge portion.

In accordance with still another aspect of the present invention, a hinge for an oven door comprises a guide member adapted for connection to an associated oven door and a claw pivotably connected to the guide member. The claw is adapted for releasable sliding engagement with an associated oven body. The hinge further comprises a link pivotably connected to the claw. A dampener is operably connected to and between the link and the guide member.

One advantage of the present invention resides in the provision of a dampened hinge system that includes a dampener that is integral to a first hinge portion of the hinge system.

Another advantage of the present invention is found in the provision of a dampened hinge system that is less expensive to manufacture and to incorporate into a given appliance.

A further advantage of the present invention is the provision of a dampened hinge system that can provide one or more secondary door position such as a broil stop position.

Still another advantage of the present invention results from the provision of a dampened hinge system wherein the type of dampener mechanism can be altered without requiring alteration of other components of the hinge system.

A further advantage of the present invention is found in the provision of a dampened hinge system that can be adjusted to operate effectively with varying door weights.

A still further advantage of the present invention resides in the provision of a dampened hinge system that can be installed by an appliance re-seller after the appliance has been manufactured.

Still other benefits and advantages of the present invention will become apparent to those of ordinary skill in the art to which the invention pertains upon reading and understanding this specification.

BRIEF DESCRIPTION OF THE DRAWINGS

The invention comprises various components and arrangements of components, preferred embodiments of which are illustrated in the accompanying drawings that form a part hereof and wherein.

DETAILED DESCRIPTION OF PREFERRED EMBODIMENTS

Figure 1A:
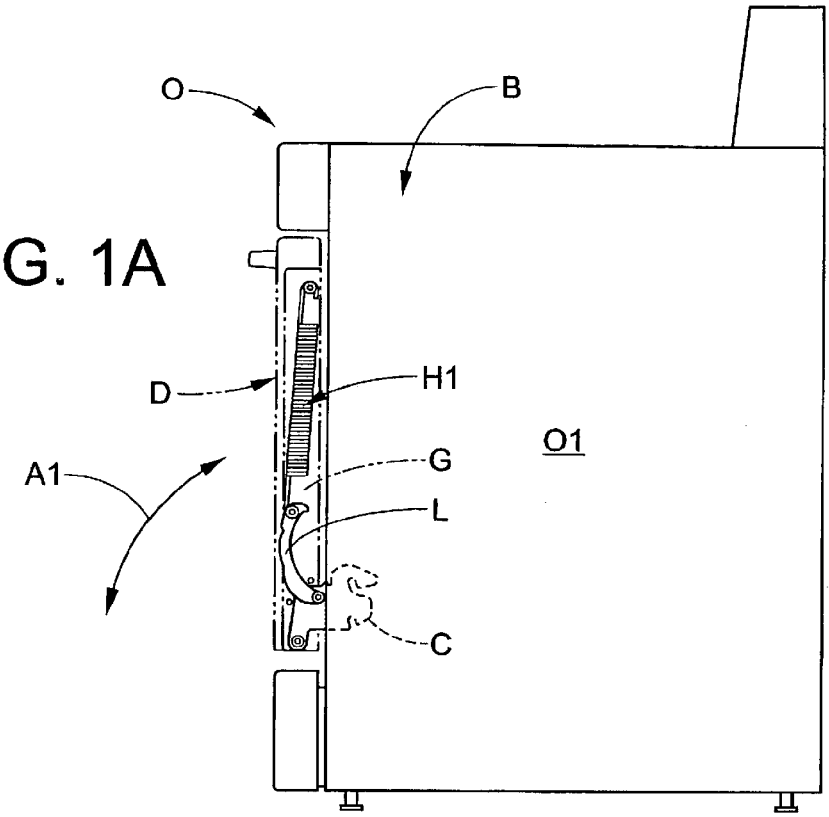
FIG. 1A is a diagrammatic illustration of a first (right) lateral side of an oven with the oven door in the closed position and incorporating a dampened hinge system formed in accordance with the present invention.
Figure 1B:
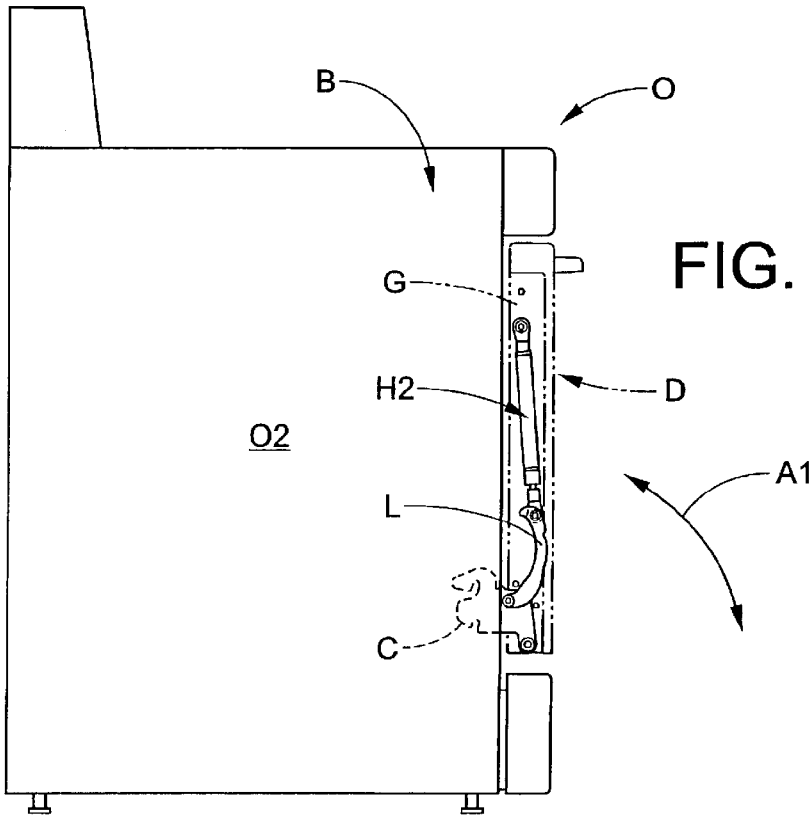
FIG. 1B is a diagrammatic illustration of a second (left) lateral side of the oven of FIG. 1A.
Figure 2A:
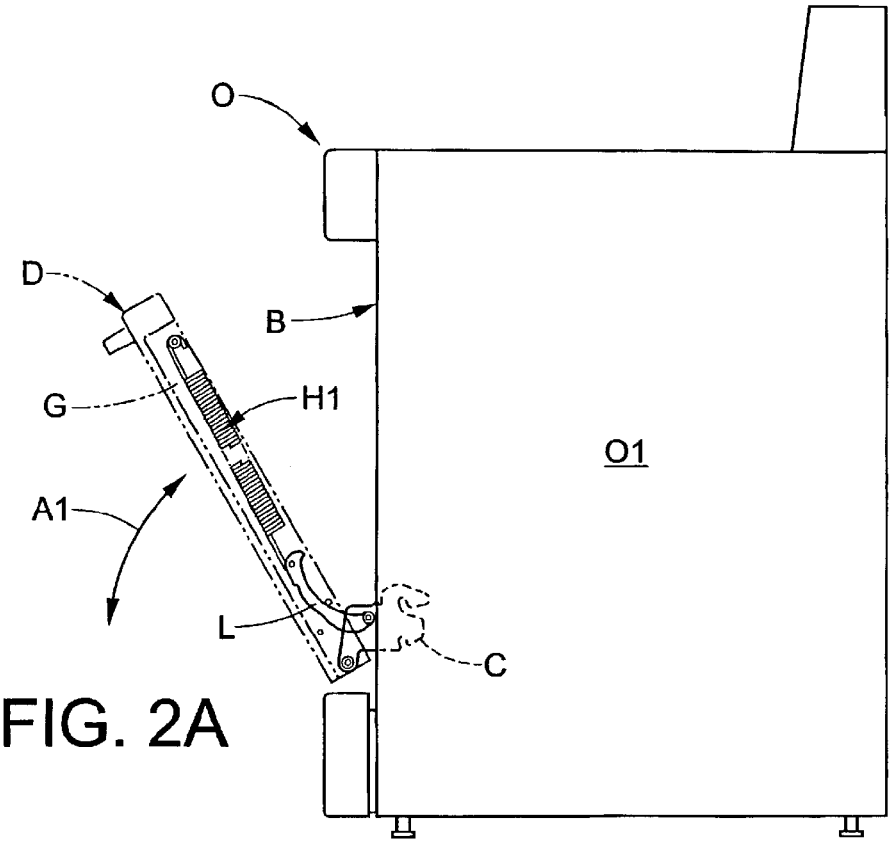
FIGS. 2A and 2B correspond to FIGS. 1A and 1B, respectively, but show the oven door in a secondary, broil-stop position.
Figure 2B:
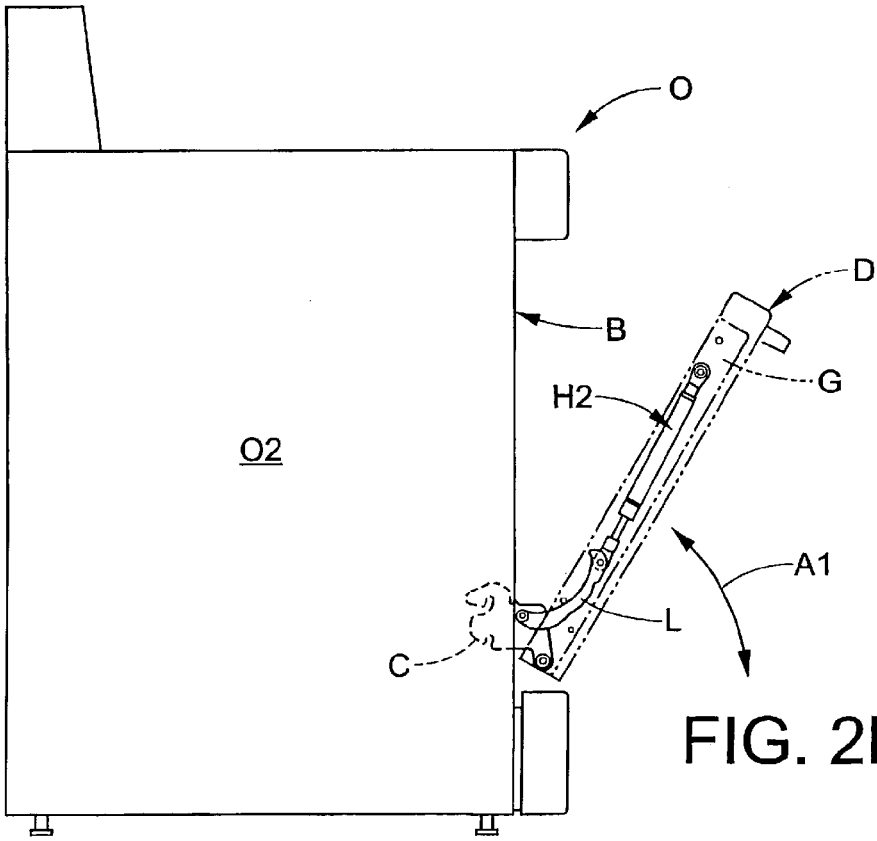
Figure 3A:
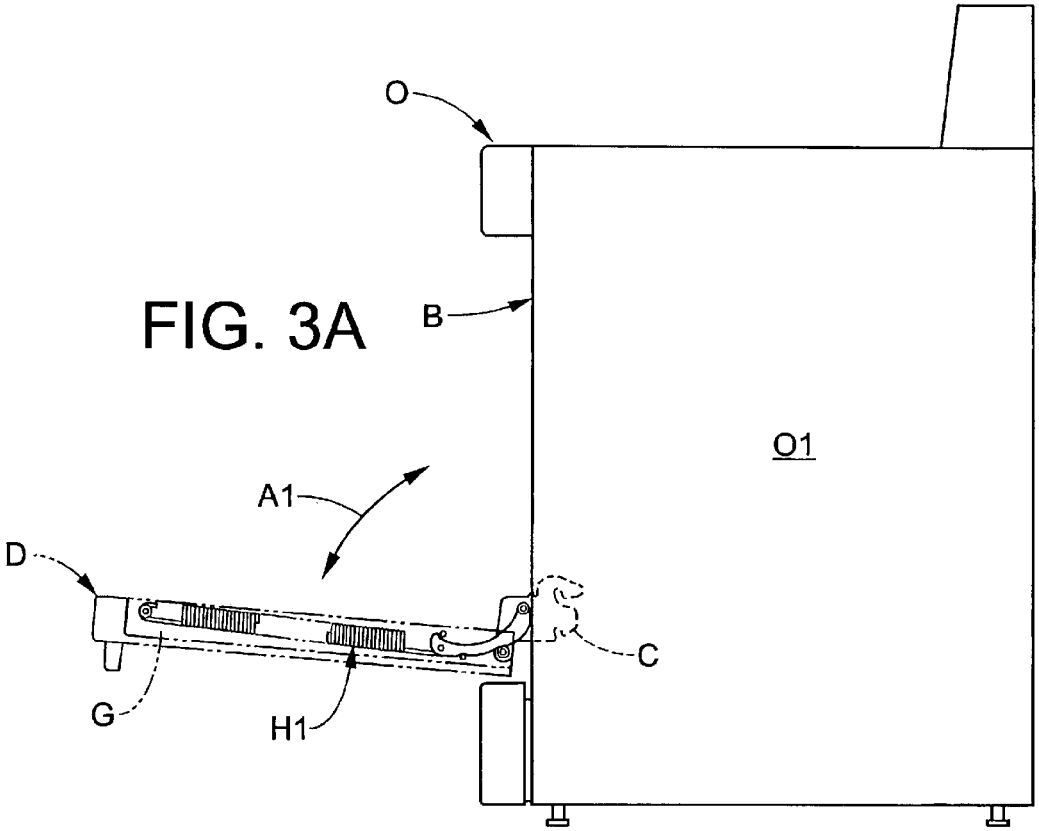
FIGS. 3A and 3B correspond to FIGS. 1A and 1B, respectively, but show the oven door in an opened position.
Figure 3B:
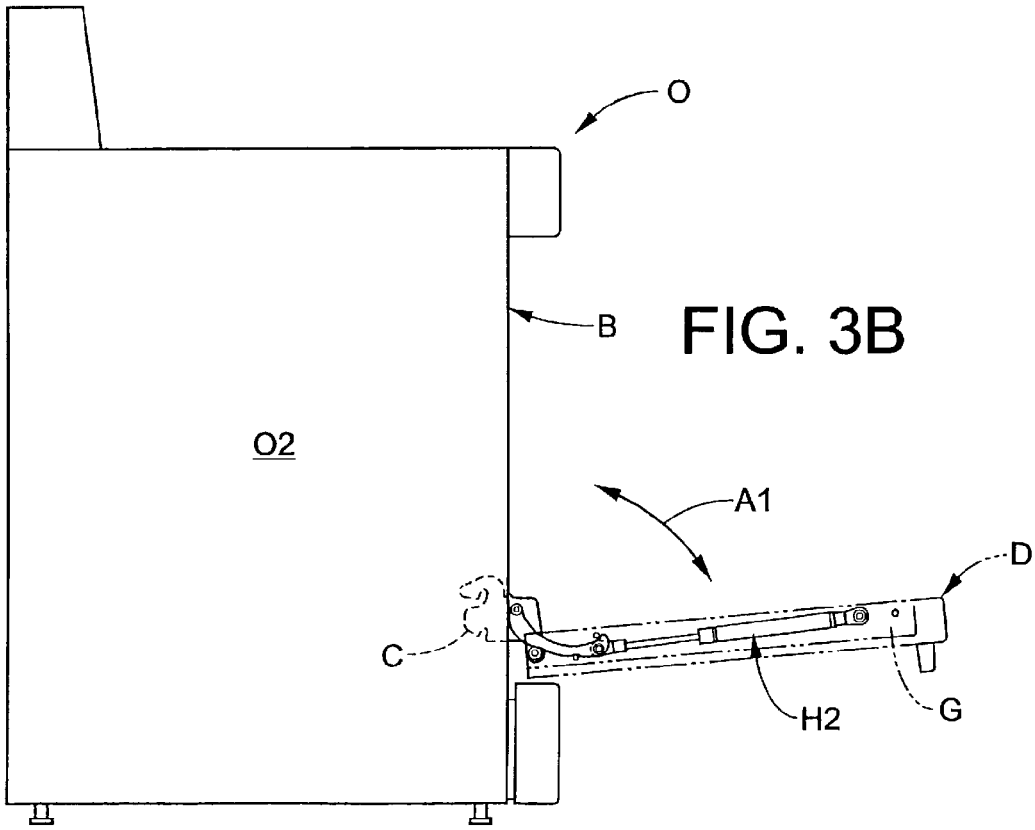

Referring now to the drawings, which are for purposes of illustrating a preferred embodiment only and are not intended to be limiting in any way, a stove or oven O is shown in FIGS. 1A–3B and includes a dampened hinge system formed in accordance with the present invention. The oven O, apart from the dampened hinge system, is conventional and comprises a body B and a door D. The door D when closed as shown in FIGS. 1A and 1B sealingly covers an entrance opening to a cooking compartment defined in the body B. The door D pivots on an arc A1 relative to the body B between the closed position (FIGS. 1A and 1B) to a fully-opened position (FIGS. 3A and 3B). The door D is also movable to a secondary or "broil-stop" position shown in FIGS. 2A and 2B as is commonly required for broiling operations and the like.

As described in full detail below, a dampened hinge system formed in accordance with the present invention is used to pivotably interconnect the body B and door D so that the door D can pivots relative to the body B as just described. With continuing reference to FIGS. 1A–3B, a dampened hinge system provided in accordance with the present invention comprises first and second hinge portions H1,H2 that cooperate to pivotably connect the door D to the body B. More particularly, the first and second hinge portions H1,H2 are located respectively adjacent opposite first and second lateral sides O1,O2 of the oven/door assembly O,D.

The hinge portions H1,H2 are shown in FIGS. 4–6A. The hinge portions H1,H2 have many components in common and, for clarity, like reference numerals/letters are used to identify like components of the hinge portions H1,H2.

Each hinge portion H1,H2 comprises an elongated guide member G preferably defined as a channel by a metal stamping having a generally U-shaped cross-section so that a central recess R is defined along the length of the guide channel. The guide channel G of each hinge portion includes a first axial end G1 and an opposite, second axial end G2. Each hinge portion also comprises a claw C pivotably connected to the guide channel G adjacent the first end G1 thereof by a suitable pivot pin such as a rivet or other fastener F1. Each hinge portion H1,H2 further comprises a link L having a first end L1 and a second end L2 spaced from the first end. In the illustrated, preferred embodiment, the link L is defined by first and second identical link members La,Lb arranged in close parallel relation to each other as may be seen most clearly with reference to FIGS. 4, 5B and 6B. The first end L1 of each link L is pivotably connected to the claw C by way of a second rivet or other fastener F2 at a location spaced from where the claw C is pivotably connected to the guide channel G by the fastener F1.

Figure 5B:
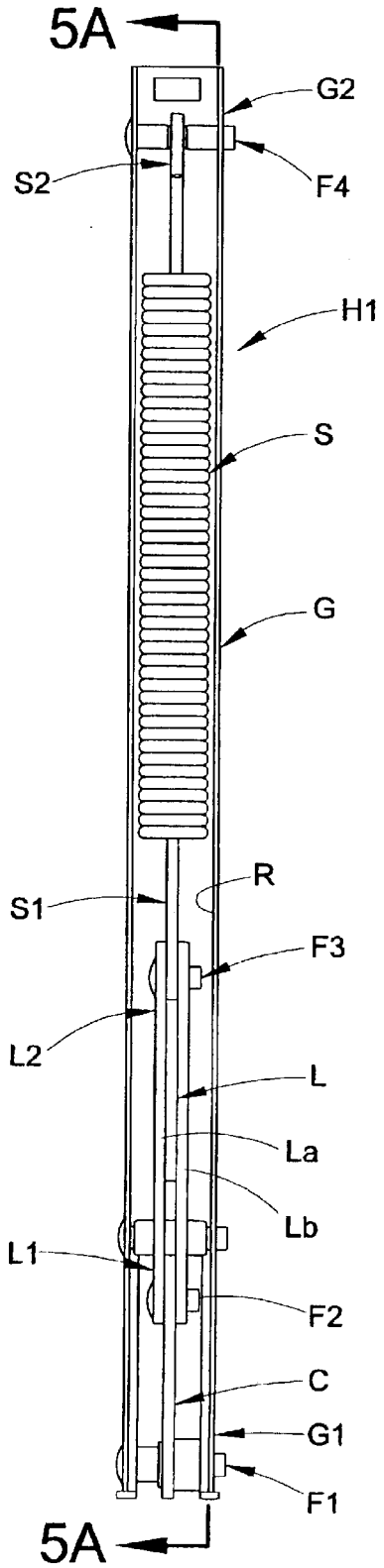
FIGS. 5A and 5B illustrate a side elevational view and a front elevational view, respectively, of a first hinge portion of a hinge system formed in accordance with the present invention, with the hinge portion arranged in a first operative position.
Figure 5A:
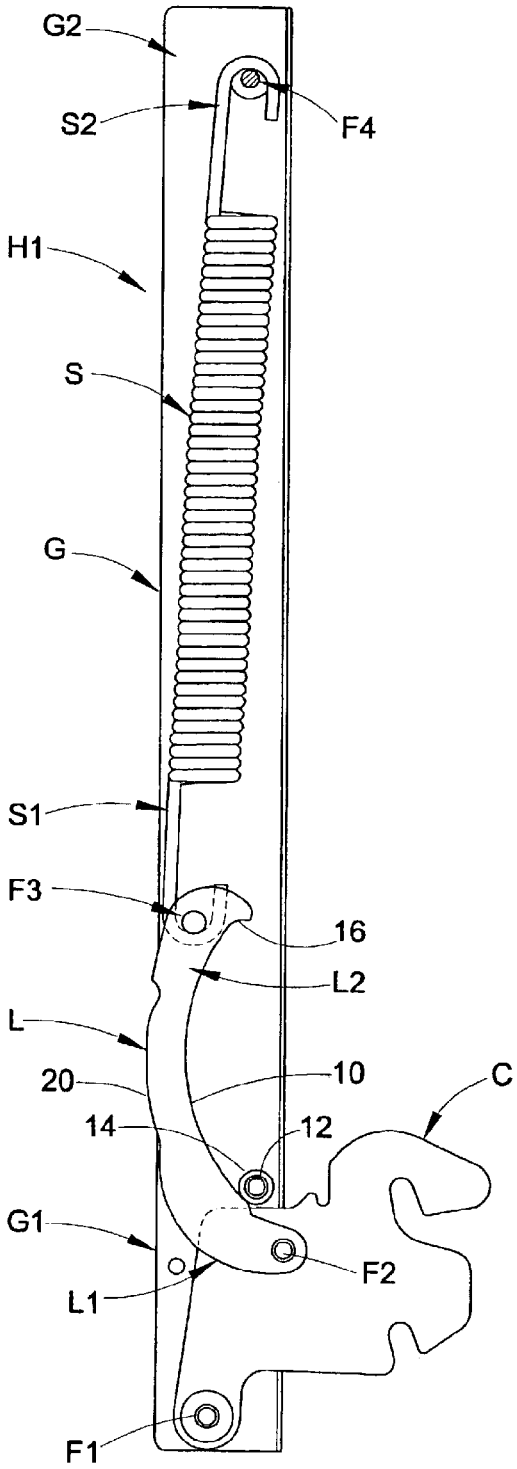
Figures 7A, 7B:
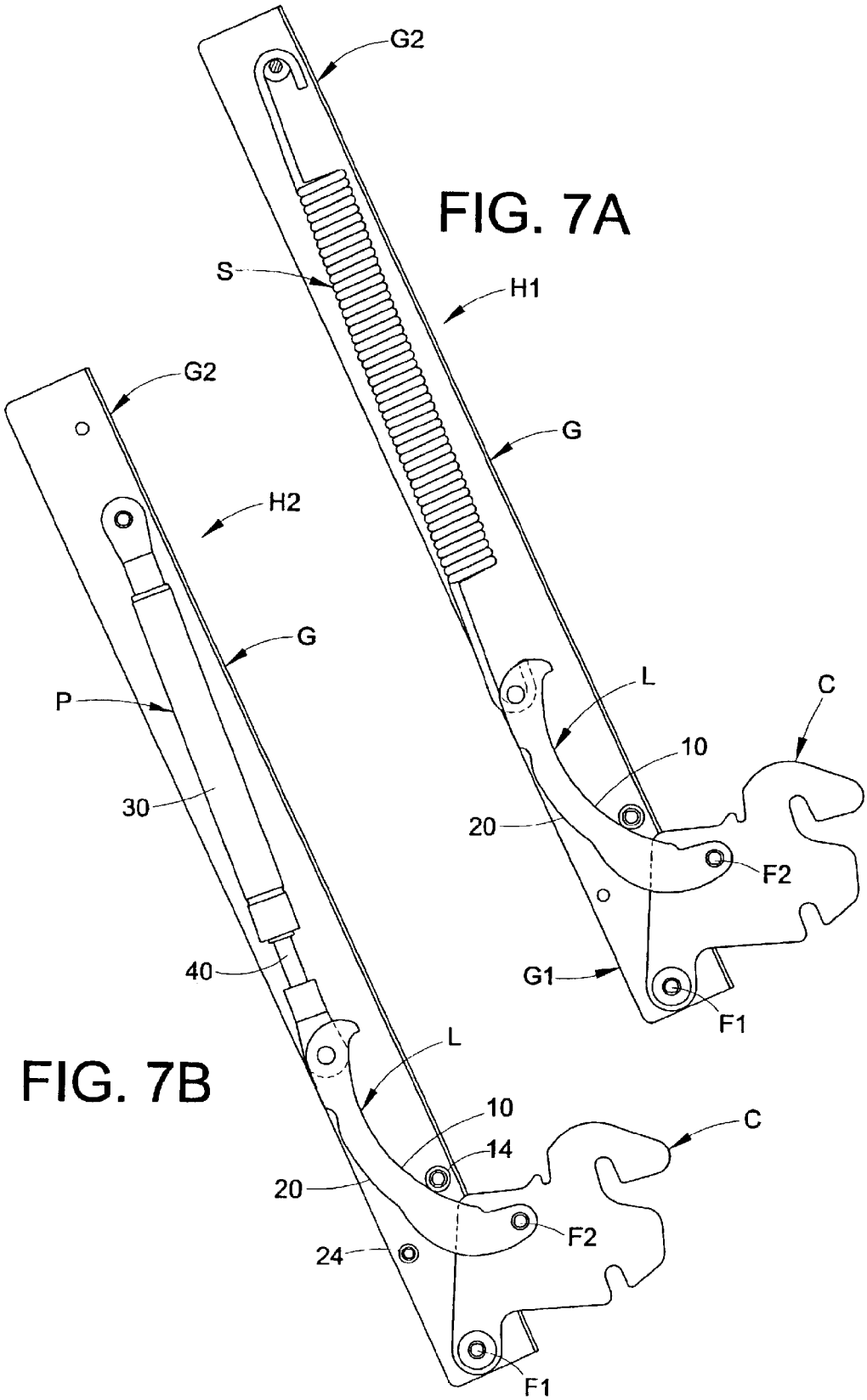
FIGS. 7A and 7B respectively illustrate side elevational views of the first and second hinge portions arranged in a second operative position; and, FIGS. 8A and 8B respectively illustrate side elevational views of the first and second hinge portions arranged in a third operative position.
Figure 8A:
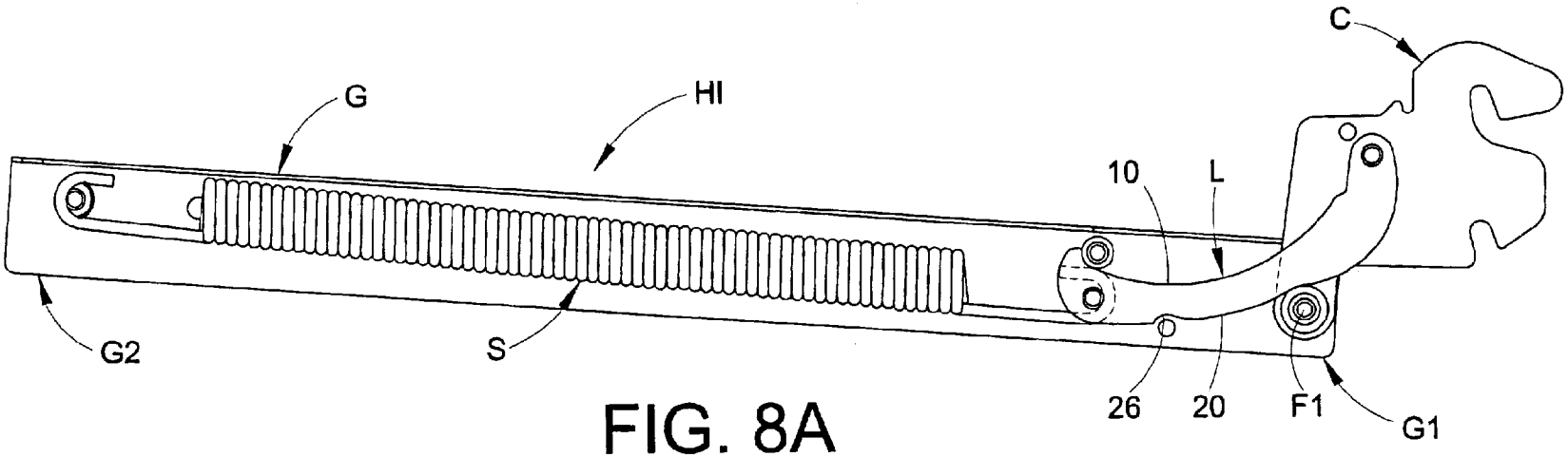

With specific reference to the hinge portion H1 shown in FIGS. 5A and 5B, a biasing member such as a coil spring S is located in the recess R. The spring S includes a first end S1 and a second end S2, each defining a hook member. The first end S1 of the spring S is connected to the link L at the second end L2. The second end S2 of the spring S is connected to or adjacent the second end G2 of the guide channel. More particularly, the first end S1 of the spring S defines a hook that is engaged with a rivet or other fastener F3 that passes through the link members La,Lb at the second end L2 of the link L. Similarly, the second end S2 of the spring S defines a hook that is engaged with a rivet or other fastener F4 that is connected to the guide channel G and that spans the recess R at the second end G2 of the guide channel. The second end S2 of the spring S can also be connected directly to the second end G2 of the guide channel. In this position, the spring biases the hinge portion into a first, home position as shown in FIG. 5A and corresponding to the closed position of the oven door D as shown in FIG. 1A. From this position, movement of the oven door D to the broil-stop position (FIG. 2A) and/or the opened position (FIG. 3A) results in elongation of the spring as shown in FIGS. 7A and 8A).

Figure 6B:
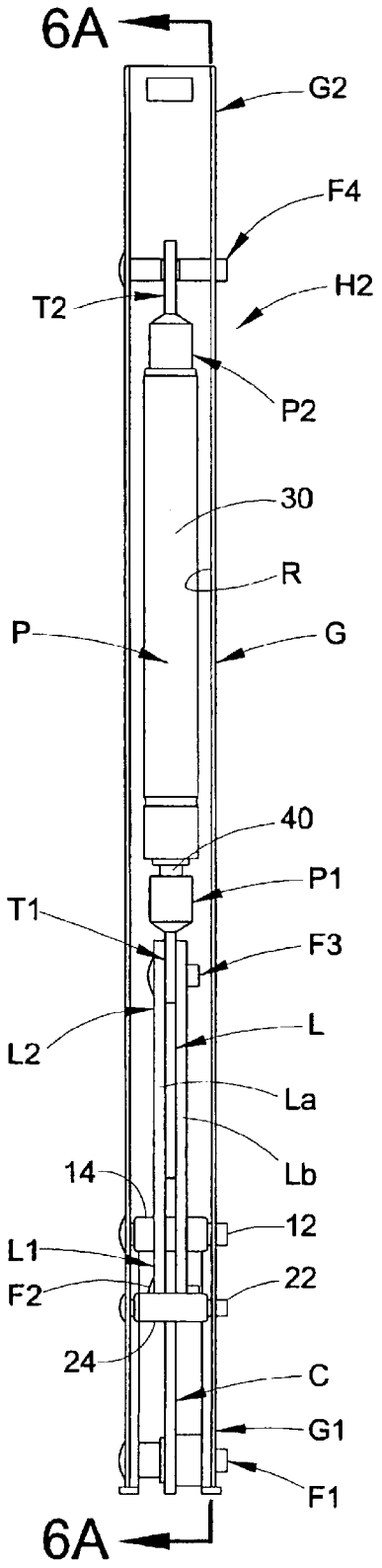
FIGS. 6A and 6B illustrate a side elevational view and a front elevational view, respectively, of a second hinge portion of a hinge system formed in accordance with the present invention, with the hinge portion arranged in a first operative position.
Figure 6A:
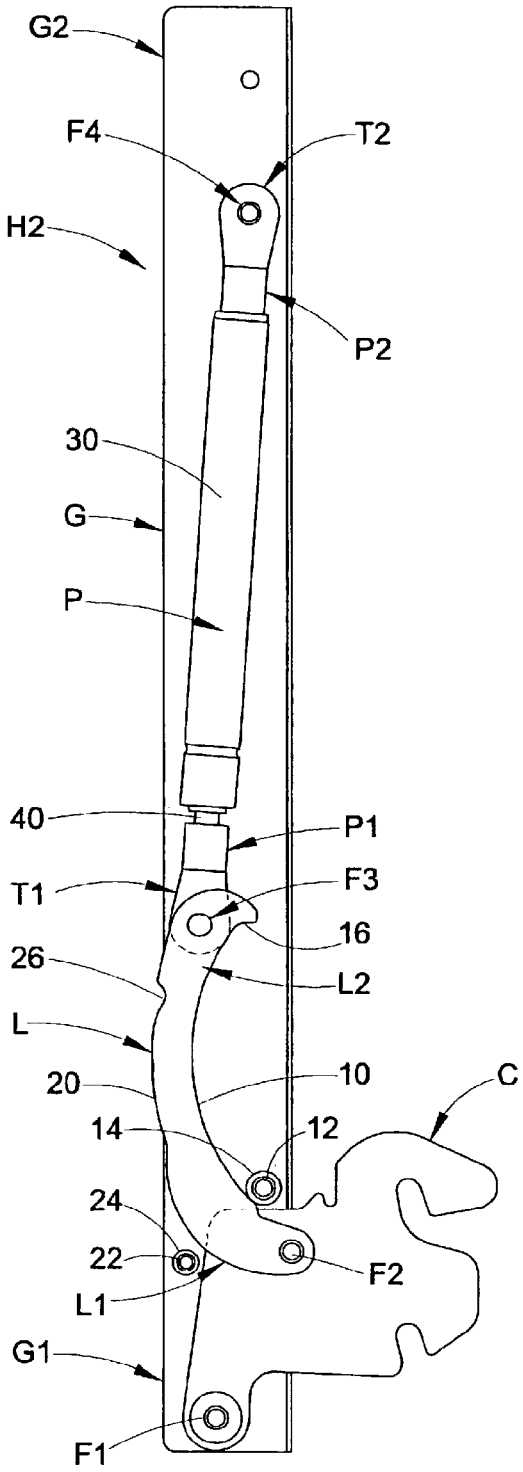

With reference to the hinge portion H2 shown in FIGS. 6A and 6B, a dampener or dampening means such as a gas-spring or oil spring P is located in the recess R. The dampener P includes a first end P1 and a second end P2 defining or including respective mounting tabs T1,T2. Each mounting tab T1,T2 defines an aperture. The first end P1 of the dampener P is connected to the link L at the second end L2. The second end P2 of the dampener P is connected to or adjacent the second end G2 of the guide channel. More particularly, the first end P1 of the dampener P is connected to the second end L2 of the link L by way of a rivet or other fastener F3 that passes through the link members La,Lb and the aperture defined in the tab T1. The opposite, second end P2 of the dampener P is connected to or adjacent the second end G2 of the guide channel G by way of a rivet or other fastener F4 that is connected to the guide channel and that spans the recess R at the second end G2 of the guide channel.

The dampener P, itself, is conventional and comprises a cylinder or housing 30 and a rod 40 slidably disposed in the housing 30. In the preferred embodiment, the rod 40 is not biased into or out of the housing 30. However, the dampener P could be provided by a fluid cylinder including a biased rod without departing from the overall scope and intent of the present invention. Furthermore, the dampener P can be a pull-damper that dampens movement of the rod 40 out of the housing 30 only, a push-damper that dampens movement of the rod 40 into the housing 30 only or a push/pull-damper that dampens movement of the rod 40 both into and out of the housing 30. In the illustrated arrangement, which could be reversed, the mounting tab T1 is connected to the rod 40 and the mounting tab T2 is connected to the housing 30.

Figure 4:
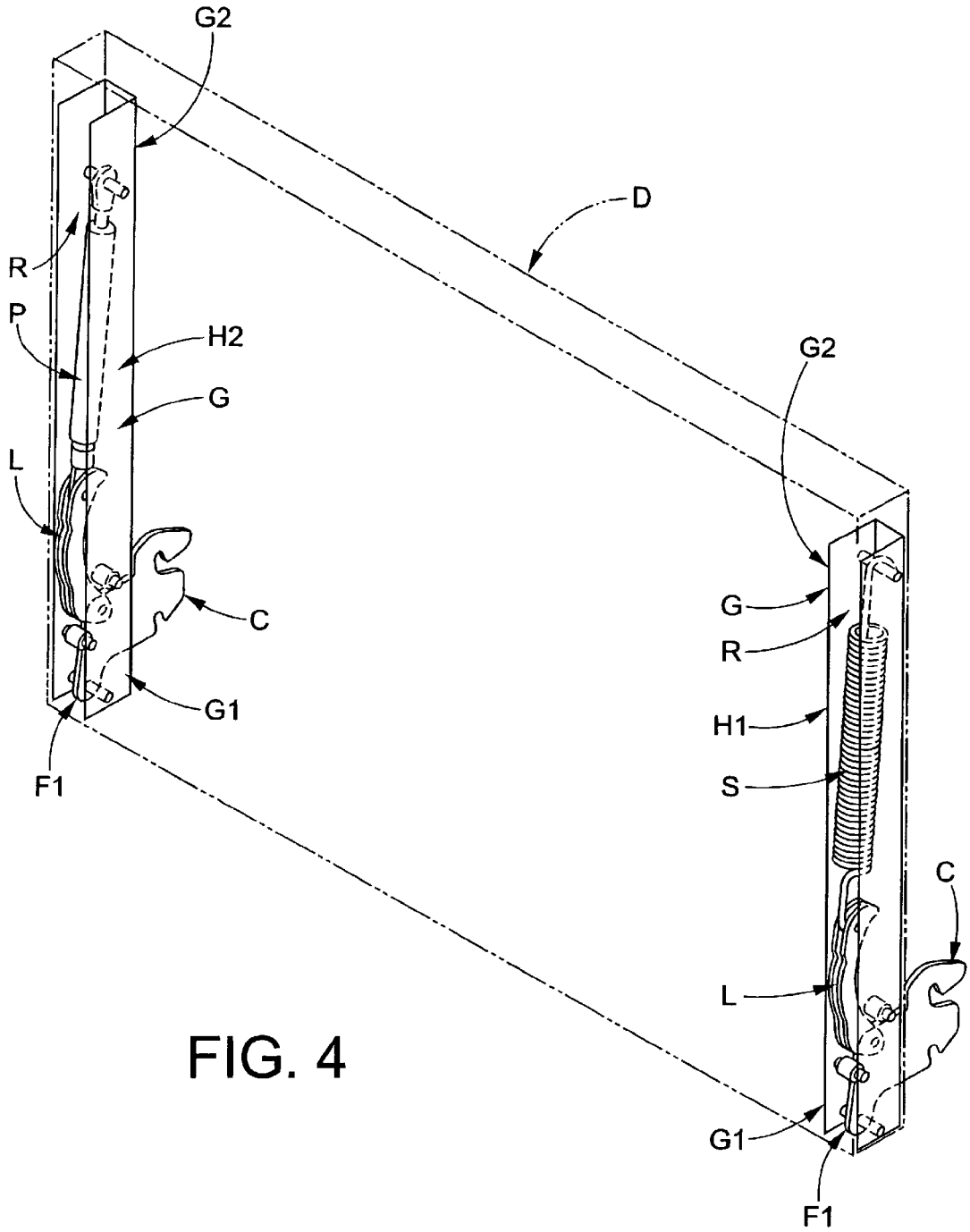
FIG. 4 is an isometric view of an oven door incorporating a hinge system formed in accordance with the present invention.

FIG. 4 illustrates the door D of the oven O with portions of the door removed for clarity. It can be seen that the guide channels G of the hinge portions H1,H2 are connected to opposite lateral sides D1,D2 of the door D, respectively, with the claw C of each hinge assembly projecting outwardly from an inner face of the door. As is well known in the art and as is shown in FIGS. 1A–3B, the claw C of each hinge assembly is slidably inserted into a female receiving portion of the oven body B to connect the door D to the oven body B by way of the hinge portions H1,H2. Of course, the claw C can take other forms and can be otherwise connected to the oven body B without departing from the overall scope and intent of the present invention.

Figure 8B:
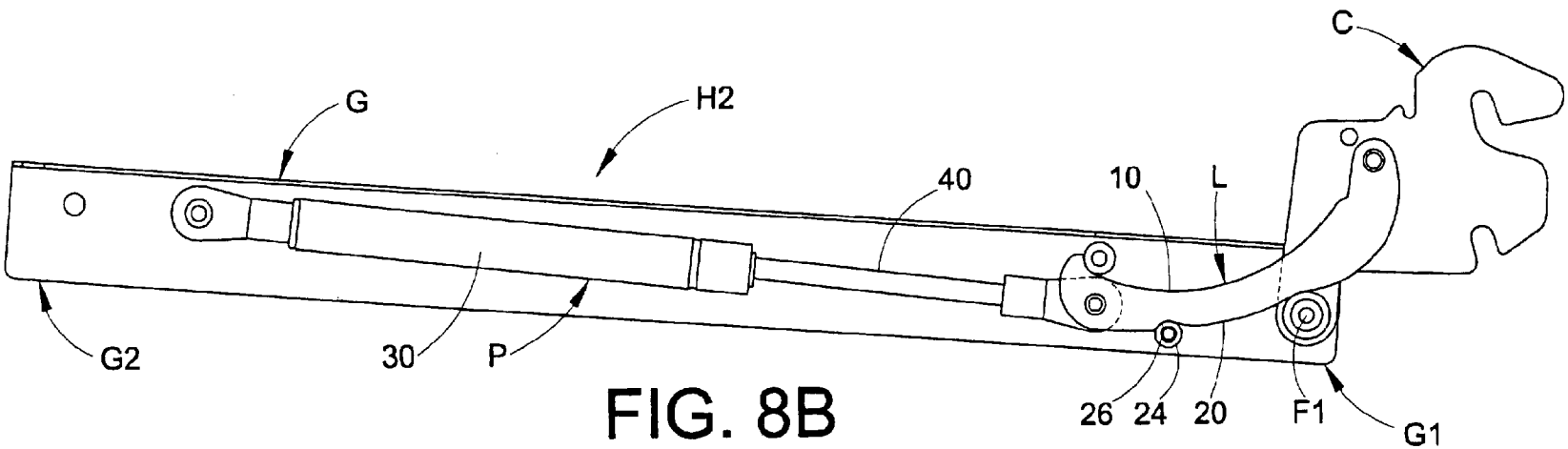

Referring particularly to FIGS. 5A and 6A, the links L are defined by the parallel link members La,Lb to include a first edge 10 and a second edge 20. A roller or other rotatable or non-rotatable link control member 14 is fixedly secured in the recess R of the guide channel G by a rivet 12 or other fastener. The link control member 14 is in contact with the first edge 10 of the link L and the first edge 10 rides on the link control member 14 during pivoting movement of the guide channel G relative to the claw C as shown in FIGS. 7A and 7B and as discussed below. The first edge 10 of the link L defines a hook or other dwell point 16 that receives the link control member 14 when the guide member is pivoted relative to the claw C a maximum amount (see FIGS. 8A and 8B). As shown in FIGS. 8A and 8B, the fastener F1 (and any sleeve, roller or the like carried thereby) abuts the second edge 20 of the link L when the guide member G is pivoted into the illustrated position. The fastener F1 and the link control member 14 define a stop beyond which the link L cannot move additionally away from the second end G2 of the guide channel toward the first end G1 of the guide channel. act to limit further support the link L and prevent movement of same to further support the link L and prevent any damage thereto.

The hinge portion H2 comprises a second link control member 24 (see FIGS. 6A, 6B, 7B, 8B) such as a roller or other non-rolling member, held in the recess R of the guide channel by a rivet 22 or other fastener. This second link control member 24 is located adjacent the second edge 20 of the link member L and prevents undesired movement of the link L out of the recess R defined by the guide channel G. Those of ordinary skill in the art will appreciate that the hinge portion H1 need not a second link control member owing to the biasing force of the coil spring S.

Operation of the dampened hinge system hinge system in accordance with the present invention will now be described with reference to FIGS. 6A–8B. As described above, the hinge portions H1,H2 are shown in a first operative position in FIGS. 6A and 7A. This first operative hinge position corresponds to the door D of the oven O being in the closed position. When the door D is pulled open to the broil-stop position, against the biasing force of the spring S, the hinge portions H1,H2 are moved into a second operative position as shown respectively in FIGS. 7A,7B. The first hinge portion H1 is designed, based upon the design of the oven door D, so that the biasing force of the spring S acts against the weight of the door D to retain the first edge 10 of the link L against the link control member 14 as shown in FIG. 7A without support of the door, i.e., so that the door is self-supported in the broil-stop position. The hinge portion H2 assumes a corresponding second operative.

Movement of the oven door D from the broil-stop position to a position between the broil-stop position and the fully opened position (preferably to a position where the door is located at approximately a 30° angle to the oven body B) positions the door D so that it will fall under its own weight in a gentle, dampened manner to the fully-opened position if the damper P is a pull-damper or a push/pull-damper. This, then results in the hinge portions being positioned in a third operative position as shown in FIGS. 8A and 8B. As noted above, the link control member 14 and the fastener F1 prevent further movement of the link L of each hinge portion H1,H2 toward the first end G1 of the guide channel G beyond the position as shown in FIGS. 8A and 8B.

If the damper is a push-damper or a push/pull-damper, the door D will also close in a dampened fashion under force of the spring S after it is moved to a partially closed position located somewhere between the fully opened and the broil-stop positions.

Although the hinge system of the present invention has been described as including a dampener P as part of only one of the first and second hinge portions, those of ordinary skill in the art will recognize that both hinge portions H1,H2 can comprise a dampener without departing from the overall scope and intent of the present invention. For example, the hinge portion H1 can comprise a dampener P in addition to or as an alternative to the spring S. If both the dampener P and spring S are included, they can be integrated into a single sub-assembly or kept separate. In one such example, the spring S and dampener P are arranged co-axially. Also, while it is preferred that the dampener P be an oil-dampener, a gas-dampener or any other fluid-actuated or other dampener can be used without departing from the overall scope and intent of the present invention.

The guide channel G, the claw C and link members La,Lb are preferably metal stampings, and the spring S is preferably also metal. It is not intended, however, that the invention or any components of same be limited to any particular material, and it is contemplated that any suitable materials such as polymeric materials and the like be used.

Other modifications and alterations will occur to those of ordinary skill in the art to which the invention pertains upon reading and understanding this specification. It is intended that the present invention, as defined by claims, be construed as encompassing all such modifications and alterations.

Having thus described the preferred embodiments, what is claimed is:

1. A dampened hinge system for connecting an appliance door to an appliance body, said hinge system comprising:

first and second hinge portions each comprising a guide member adapted for connection to an associated appliance door, a claw pivotably connected to the guide member and adapted for engagement with an associated appliance body, and a link pivotably connected to the claw;

a spring having a first end connected to said link of said first hinge portion and a second end connected to said guide member of said first hinge portion; and, an unbiased dampener operably connected between said link of said second hinge portion and said guide member of said second hinge portion, wherein said second hinge portion is dampened and wherein said guide member of said second hinge portion and said claw of said second hinge portion are unbiased relative to each other.

2. The dampened hinge system as set forth in claim 1, wherein said dampener comprises one of a gas-actuated dampener and an oil-actuated dampener, said dampener comprising a housing and a rod slidably movable into and away from said housing, said rod connected to one of said guide member and said link of said second hinge portion and said housing connected to the other of said guide member and said link of said second hinge portion.

3. The dampened hinge system as set forth in claim 2, wherein said spring comprises a coil spring.

4. The dampened hinge system as set forth in claim 1, wherein said guide member of said first hinge portion and said guide member of said second hinge portion each comprise a U-shaped channel defining a recess, said spring and link of said first hinge portion at least partially located in said recess of said guide member and said dampener and said link of said second hinge portion at least partially located in said recess of said guide member of said second hinge portion.

5. The dampened hinge system as set forth in claim 1, wherein said link of said first hinge portion and said link of said second hinge portion each comprise first and second parallel link members.

6. The dampened hinge system as set forth in claim 5, wherein said first and second parallel link members are identical to each other.

7. The dampened hinge system as set forth in claim 1, wherein said dampener comprises at least one of a push-dampener, a pull-dampener and a push/pull-dampener.

8. The dampened hinge system as set forth in claim 1, wherein said first and second hinge portions are movable to a first operative position corresponding to a closed position of said associated appliance door, a second operative position corresponding to a broil-stop position of said associated appliance door and a third operative position corresponding to an opened position of said associated appliance door, and wherein said dampener provides greater dampening effect when said second hinge portion moves from said second operative position to said third operative position as compared to movement of said second hinge portion from said third operative position to said second operative position.

9. The dampened hinge system as set forth in claim 8, wherein said claw of said first hinge portion is connected to a first end of said link of said first hinge portion and said spring is connected to a second end of said link of said first hinge portion, and wherein said claw of said second hinge portion is connected to a first end of said link of said second hinge portion and said dampener is connected to a second end of said link of said second hinge portion.

10. The dampened hinge system as set forth in claim 9, wherein:

said first hinge portion comprises a first link control member connected to said guide channel, and wherein said link of said first hinge portion defines a first edge that rides on the first link control member when said guide channel of said first hinge portion is pivoted relative to said claw of said first hinge portion; and, said second hinge portion comprises a second link control member connected to said guide channel, and wherein said link of said second hinge portion defines a first edge that rides on the second link control member when said guide channel of said second hinge portion is pivoted relative to said claw of said second hinge portion.

11. The dampened hinge system as set forth in claim 10, wherein:

said second end of said link of said first hinge portion defines a dwell point for receiving and retaining said first link control member when said guide channel of said first hinge portion is pivoted to said third operative position relative to said claw of said first hinge portion; and, said second end of said link of said second hinge portion defines a dwell point for receiving and retaining said second link control member when said guide channel of said second hinge portion is pivoted to said third operative position relative to said claw of said second hinge portion.

12. A dampened hinge system for connecting an appliance door to an appliance body, said hinge system comprising:

first and second hinge portions each comprising a guide member adapted for connection to an associated appliance door, a claw pivotably connected to the guide member and adapted for engagement with an associated appliance body, and a link pivotably connected to the claw;

a spring having a first end connected to said link of said first hinge portion and a second end connected to said guide member of said first hinge portion; and, a dampener operably connected between said link of said second hinge portion and said guide member of said second hinge portion, wherein:

said first and second hinge portions are movable to a first operative position corresponding to a closed position of said associated appliance door, a second operative position corresponding to a broil-stop position of said associated appliance door and a third operative position corresponding to an opened position of said associated appliance door;

said claw of said first hinge portion is connected to a first end of said link of said first hinge portion and said spring is connected to a second end of said link of said first hinge portion, and wherein said claw of said second hinge portion is connected to a first end of said link of said second hinge portion and said dampener is connected to a second end of said link of said second hinge portion;

said first hinge portion comprises a first link control member connected to said guide channel, and wherein said link of said first hinge portion defines a first edge that rides on the first link control member when said guide channel of said first hinge portion is pivoted relative to said claw of said first hinge portion;

said second hinge portion comprises a second link control member connected to said guide channel, and wherein said link of said second hinge portion defines a first edge that rides on the second link control member when said guide channel of said second hinge portion is pivoted relative to said claw of said second hinge portion;

said second end of said link of said first hinge portion defines a dwell point for receiving and retaining said first link control member when said guide channel of said first hinge portion is pivoted to said third operative position relative to said claw of said first hinge portion;

said second end of said link of said second hinge portion defines a dwell point for receiving and retaining said second link control member when said guide channel of said second hinge portion is pivoted to said third operative position relative to said claw of said second hinge portion;

said claw of said first hinge portion is pivotably connected to said guide channel of said first hinge portion by a first fastener, and wherein said link of said first hinge portion defines a second edge, opposite said first edge, that abuts said first fastener when said first hinge portion is moved to said third operative position; and, said claw of said second hinge portion is pivotably connected to said guide channel of said second hinge portion by a second fastener, and wherein said link of said second hinge portion defines a second edge, opposite said first edge, that abuts said second fastener when said guide channel of said second hinge portion is moved to said third operative position.

13. An appliance comprising:

a body;

a door;

first and second hinge portions for pivotably connecting the door to the body, each of said first and second hinge portions comprising a guide member adapted for connection to the door, a claw pivotably connected to the guide member and adapted for engagement with the body, and a link pivotably connected to the claw;

a spring having a first end connected to said link of said first hinge portion and a second end connected to said guide member of said first hinge portion; and, an unbiased dampener operably connected between said link of said second hinge portion and said guide member of said second hinge portion, said claw of said second hinge portion and said guide member of said second hinge portion being unbiased relative to each other.

14. The appliance as set forth in claim 13, wherein said dampener comprises one of a gas-actuated dampener and an oil-actuated dampener, said dampener comprising a housing and a rod slidably movable into and away from said housing, said rod connected to one of said guide member and said link of said second hinge portion and said housing connected to the other of said guide member and said link of said second hinge portion.

15. The appliance as set forth in claim 14, wherein said spring comprises a coil spring.

16. The appliance as set forth in claim 13, wherein said guide member of said first hinge portion and said guide member of said second hinge portion each comprise a U-shaped channel defining a recess, said spring and link of said first hinge portion at least partially located in said recess of said guide member and said dampener and said link of said second hinge portion at least partially located in said recess of said guide member of said second hinge portion.

17. The appliance as set forth in claim 13, wherein said link of said first hinge portion and said link of said second hinge portion each comprise first and second parallel link members.

18. The appliance as set forth in claim 17, wherein said first and second parallel link members are identical to each other.

19. The appliance as set forth in claim 13, wherein said dampener comprises at least one of a push-dampener, a pull-dampener and a push/pull-dampener.

20. The appliance as set forth in claim 13 wherein said first and second hinge portions are movable to a first operative position corresponding to a closed position of said door, a second operative position corresponding to a broil-stop position of said door and a third operative position corresponding to an opened position of said door, wherein said dampener provides greater dampening effect on movement of said door from said closed position to said opened position as compared to movement of said door from said opened position to said closed position.

21. The appliance as set forth in claim 20, wherein said claw of said first hinge portion is connected to a first end of said link of said first hinge portion and said spring is connected to a second end of said link of said first hinge portion, and wherein said claw of said second hinge portion is connected to a first end of said link of said second hinge portion and said dampener is connected to a second end of said link of said second hinge portion.

22. The appliance as set forth in claim 21, wherein:

said first hinge portion comprises a first link control member connected to said guide channel, and wherein said link of said first hinge portion rides on the first link control member when said guide channel of said first hinge portion is pivoted relative to said claw of said first hinge portion; and, said second hinge portion comprises a second link control member connected to said guide channel, and wherein said link of said second hinge portion rides on the second link control member when said guide channel of said second hinge portion is pivoted relative to said claw of said second hinge portion.

23. The appliance as set forth in claim 22, wherein:

said second end of said link of said first hinge portion defines a dwell point for receiving and retaining said first link control member when said guide channel of said first hinge portion is pivoted to said third operative position relative to said claw of said first hinge portion; and, said second end of said link of said second hinge portion defines a dwell point for receiving and retaining said second link control member when said guide channel of said second hinge portion is pivoted to said third operative position relative to said claw of said second hinge portion.

24. An appliance comprising:

a body;

a door;

first and second hinge portions for pivotably connecting the door to the body, each of said first and second hinge portions comprising a guide member adapted for connection to the door, a claw pivotably connected to the guide member and adapted for engagement with the body, and a link pivotably connected to the claw;

a spring having a first end connected to said link of said first hinge portion and a second end connected to said guide member of said first hinge portion; and, a dampener operably connected between said link of said second hinge portion and said guide member of said second hinge portion, wherein:

said first and second hinge portions are movable to a first operative position corresponding to a closed position of said door, a second operative position corresponding to a broil-stop position of said door and a third operative position corresponding to an opened position of said door;

said claw of said first hinge portion is connected to a first end of said link of said first hinge portion and said spring is connected to a second end of said link of said first hinge portion, and wherein said claw of said second hinge portion is connected to a first end of said link of said second hinge portion and said dampener is connected to a second end of said link of said second hinge portion;

said first hinge portion comprises a first link control member connected to said guide channel, and wherein said link of said first hinge portion rides on the first link control member when said guide channel of said first hinge portion is pivoted relative to said claw of said first hinge portion;

said second hinge portion comprises a second link control member connected to said guide channel, and wherein said link of said second hinge portion rides on the second link control member when said guide channel of said second hinge portion is pivoted relative to said claw of said second hinge portion;

said second end of said link of said first hinge portion defines a dwell point for receiving and retaining said first link control member when said guide channel of said first hinge portion is pivoted to said third operative position relative to said claw of said first hinge portion;

said second end of said link of said second hinge portion defines a dwell point for receiving and retaining said second link control member when said guide channel of said second hinge portion is pivoted to said third operative position relative to said claw of said second hinge portion;

said claw of said first hinge portion is pivotably connected to said guide channel of said first hinge portion by a first fastener, and wherein said link of said first hinge portion abuts said first fastener when said first hinge portion is moved to said third operative position; and, said claw of said second hinge portion is pivotably connected to said guide channel of said second hinge portion by a second fastener, and wherein said link of said second hinge portion abuts said second fastener when said guide channel of said second hinge portion is moved to said third operative position.

25. The appliance as set forth in claim 20, wherein said door is self-supporting in said broil-stop position.

* * * * *